United States Patent [19]

Damrau

[11] 4,217,769

[45] Aug. 19, 1980

[54] METHOD OF FORMING A COATING APPLICATION ROLL

[75] Inventor: Wayne A. Damrau, Wisconsin Rapids, Wis.

[73] Assignee: Consolidated Papers, Inc., Wisconsin Rapids, Wis.

[21] Appl. No.: 950,134

[22] Filed: Oct. 10, 1978

[51] Int. Cl.[3] ..... C21D 7/06

[52] U.S. Cl. ..... 72/53; 29/121.8; 118/258

[58] Field of Search ..... 72/53, 40; 29/121.8, 29/148.4 D, 121.1, 527.4; 118/212, 258, 259, 261; 51/319, 420

[56] References Cited

U.S. PATENT DOCUMENTS

| | | | |
|---|---|---|---|
| 3,177,558 | 4/1965 | Gronholz | 29/121.8 |
| 3,379,170 | 4/1968 | Thomas | 118/261 |
| 3,412,479 | 11/1968 | Markovic | 29/121.8 |
| 4,026,007 | 5/1977 | Brower | 29/121.8 |

*Primary Examiner*—Francis S. Husar
*Assistant Examiner*—Gene P. Crosby
*Attorney, Agent, or Firm*—Gary, Juettner & Pyle

[57] ABSTRACT

A method for making an application or dip roll for applying a coating, such as an aqueous clay and starch solution, from a trough, onto a moving web on a papermaking or coating machine. The roll comprises a roll cylinder having a hard, outer surface which is not subject to attack by the coating to be used. A plurality of minute indentations are formed in the outer surface of the roll to enhance the transfer of coating from the trough to the roll. Preferably, the roll is first provided with a smooth surface finish. Then the plurality of indentations are formed by shot blasting the outer surface of the roll with hard shot. If a shot of a material subject to attack by the coating is used, the roll may be subsequently blasted with another material, not subject to such attack, so as to remove any fragments of the first shot that might have become embedded in the roll.

2 Claims, 4 Drawing Figures

METHOD OF FORMING A COATING APPLICATION ROLL

BACKGROUND OF THE INVENTION

This invention relates to a dip roll for applying a coating to a web of paper and a method of making the dip roll, and more particularly, to a dip roll having a plurality of cupped indentations on its surface for increasing the transfer of the coating liquid from a supply to the dip roll and web, and a method of making such roll.

In the manufacture of coated paper, a coater having a dip roll running in a trough is sometimes used to transfer coating liquid from the trough to the web of moving paper. In such coater the dip roll is normally located adjacent a backing roll, with the web of paper being run between the nip of the dip roll and backing roll. The dip roll does not actually contact the backing roll, as usually a small gap is provided between the rolls to control the amount of coating to be transferred to the web.

Previous dip rolls were usually made of metal, but covered with a smooth surface of rubber or plastic material or compound. One of the functions of the covering was to enhance the transfer of the coating liquid carried by the dip roll from the trough, over that of a plain metal roll. However, the rubber or plastic covering has disadvantages in that it may swell with increases in temperature, thus changing or eliminating the desired gap between dip roll and backing roll. The changing of this gap has an adverse effect, as it alters the amount of coating applied to the web. Changes in the gap, due to roll swelling can also cause coating skips, increase undesired penetration of the coating into the web, and can increase the hydrodynamic force at the backing-dip roll nip. The covering also hardens and glazes with age so that after a period of time, it must be repaired or replaced. Unfortunately, the techniques for repairing such covered dip rolls, usually by regrinding the surface of the roll or recovering it, are slow, expensive and require special, costly equipment, not usually available at a paper mill. Further, the relatively soft covering is easily damaged, making for frequent need for repair or replacement.

SUMMARY OF THE PRESENT INVENTION

The dip roll and method of making the same of the present invention eliminate the foregoing disadvantages. The dip roll of the present invention, preferably, comprises a roll made of a corrosion resistant, long wearing material, which has a plurality of minute, cupped shaped indentations formed thereon across its entire coating engaging surface to enhance the transfer of coating liquid from the trough to the web. The dip roll is, preferably, made by shot blasting a stainless steel roll with hard material, such as hardened steel shot, to form the indentations. An initial step preparatory thereto, of first turning the outer surface or outside diameter of the roll to a smooth finish may be performed. Also, a subsequent step of blasting the previously steel shot blasted surface with a non-corrosive material to remove any fragments of the steel shot so as preserve the corrosion resistance of the roll, may also be performed.

One object of the present invention is to provide a dip roll with excellent transfer of coating liquid from the coating trough to the roll, and hence to the web.

Another object of the dip roll and method of the present invention is to provide a roll which is easily made and repaired with equipment normally available in a machine shop at a paper mill.

Yet another object of the present invention is to provide a dip roll and method for producing it which are less expensive in comparison to presently used covered rolls.

These and other advantages of the dip roll and the method for making the same of the present invention will be apparent from the following written description and the accompanying figures of the drawings.

DESCRIPTION OF THE PREFERRED EMBODIMENT

Figure 1:
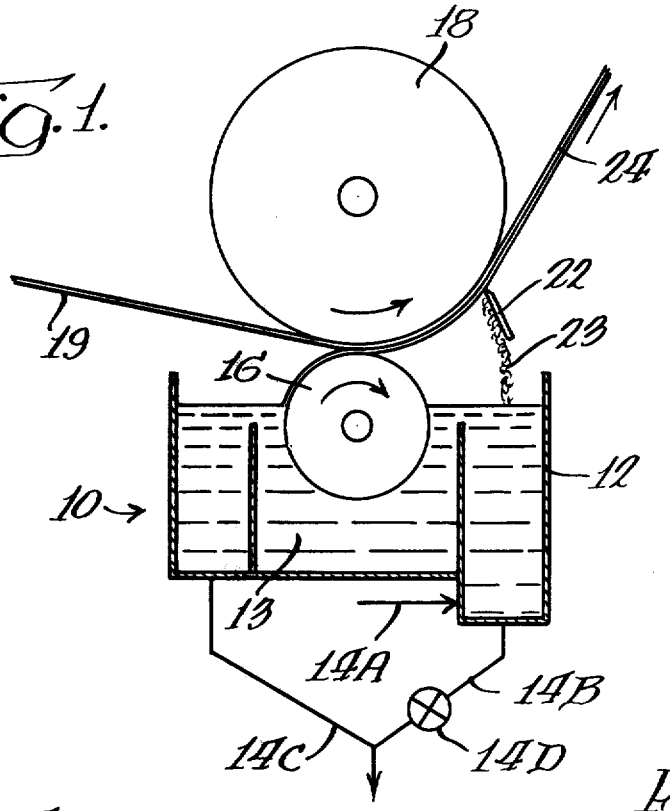
FIG. 1 is a schematic diagram of the type coater in which a dip roll of and made by the method of the present invention is utilized.

Referring to FIG. 1, a coater 10, known as a dip roll-inverted blade coater, is mounted on a papermaking or coating machine (of which only the backing roll is shown). The coater 10 includes a trough 12, filled with coating liquid 13. The trough 12 can be supplied with coating liquid by a piping system 14 shown schematically therebelow, coating being supplied to the trough, via pipe 14(*a*), and withdrawn, via pipes 14(*b*) and 14(*c*), the valve 14(*d*) being selectively operable as desired.

The coater 10 utilizes an applicator or dip roll 16 of the present invention, which is used usually with an associated backing roll 18. The paper web 19 to be coated runs between the nip of the backing roll and the dip roll. The dip roll 16 is usually spaced a small distance away from the backing roll 18 providing a gap. Generally, the width of this gap determines the amount of coating that is transferred from the dip roll 16 to web 19. The backing roll 18 is normally driven, by means not shown, at web speed. The dip roll 16 is driven to rotate (clockwise as shown in FIG. 1), carrying liquid from the trough 12 up to the web 19. The coating is then transferred from the dip roll to the web, and then doctored by a blade 22. That portion 23 of the coating scraped off by the blade 22 is returned to the trough. That portion 24 of the coating which remains on the web after being doctored forms the coating of the paper.

Figure 2:
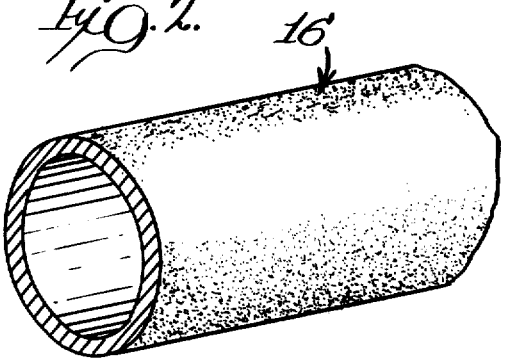
FIG. 2 is a perspective view of a portion of the roll shown in FIG. 1.

Referring to FIG. 2, the dip roll 16 of the present invention is cylindrical and formed of a material which will not be attacked or corroded by the coating material being used or applied. As coatings are usually aqueous solutions of clay and starch or other binder, a roll formed by a non-rusting material, such as 316 stainless steel is suitable.

To manufacture the dip roll 16, the following method of the present invention is used. The outer surface of the roll 16 is first machined and finished to establish an initial surface finish of approximately 16 micro-inches (0.000016 of an inch) RMS (root mean square). As used herein all RMS measurements are in micro-inches. After this initial surface is formed, the outer surface of the roll is then shot blasted with hardened steel shot which upon impact on the roll form cup shaped indentations. The shot used should be in the range of 0.030 to 0.060 inches in diameter. Number 280 steel shot of about 40–45 Rockwell "C" has been found to work satisfactory. After shot blasting, the roll should have a surface finish of approximately 300 to 500 RMS.

Figure 3:
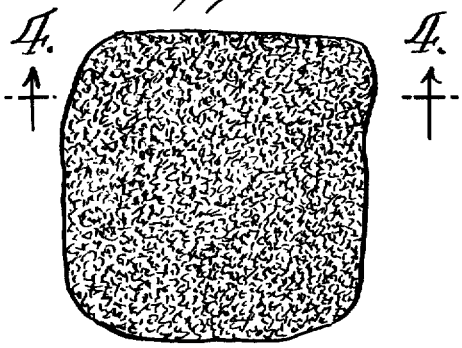
FIG. 3 is an enlarged view of a small portion of the outer surface of the roll shown in FIG. 1.
Figure 4:
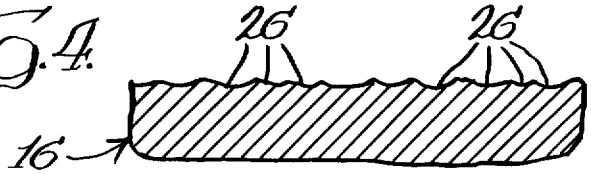
FIG. 4 is a greatly enlarged, cross-sectional view taken along the lines 4–4 of FIG. 3.

Referring to FIG. 3 and 4, after shot blasting, the surface of the roll will be pock-marked with a plurality of minute, randomly spaced, cup shaped indentations 26 over its outer cylindrical surface.

Shot blasting or peening a corrosion resistant stainless steel with the hardened steel shot can reduce the corrosion resistance if the stainless steel becomes impregnated with steel fragments from the shot. Therefore, after shot blasting with the hardened shot, the roll should be cleaned or blasted a second time with a non-corrosive material, such as glass beads, to reduce or remove any impregnated steel fragments. It has been found that 100 to 200 mesh glass beads work satisfactorily for this purpose.

Another advantage of the method of the present invention is that the stainless steel roll, which initially has a hardness of 10–15 Rockwell C, becomes even harder due to shot blasting and glass beading. It has been found that after these process steps have been carried out, the roll will have a Rockwell hardness of from 30 to 40 Rockwell C. This increase in surface hardness makes the roll even more resistant to wear or damage.

Usually all equipment needed to produce the dip roll of the present invention is readily available in the normal machine shop of a paper mill. Unlike the prior art rolls, no special equipment is needed to either make or service the rolls, and costly delays are avoided.

As mentioned above, when dip roll 16 is installed in the coater 10 it will rotate. As the dip roll rotates, its cup shaped indentations 26 assist in causing the coating liquid to adhere to the dip roll, and thus assist and increase the transfer of the coating from the trough onto the roll and to the web. In fact, the coating transfer capability of the dip roll of the present invention is believed at least equal to that provided by the heretofore used smooth, rubber or plastic covered rolls. However, unlike those prior art rolls, the dip roll of the present invention does not swell or alter the gap, or deteriorate with age, and due to its hard surface, is not easily damaged.

While only the preferred embodiment of the dip roll and the preferred method for manufacturing the same have been described and illustrated, it is to be understood that the invention is not limited thereto, but comprehends other constructions and arrangements and other steps and orders for performing the method, without departing from the scope of the invention set forth in the appended claims.

What is claimed is:

1. A method of making a coater dip roll for use directly adjacent a moving paper web, consisting of the steps of:

selecting a cylinder made of a corrosion resistant material;

providing said cylinder with an initial outer surface finish of substantially 16 microinches RMS;

shot blasting the outer surface of said cylinder with steel shot 0.030 to 0.060 inches in diameter and having a hardness of 40 Rockwell C or greater;

continuing said shot blasting until said outer surface of said cylinder has a hardness of 30 Rockwell C or greater and said outer surface has a plurality of cup shaped indentations providing a surface of 300 to 500 microinches RMS;

blasting said outer surface of said cylinder with glass beads to remove any embedded fragments of the steel shot, and rotatably mounting said cylinder in a coater and directly adjacent the moving paper web.

2. The method of claim 1, wherein said selection is made from stainless steels, and said glass blasting is done with beads of 100 to 200 mesh in size.

* * * * *